US005228849A

United States Patent [19]

Frigiere

[11] Patent Number: 5,228,849

[45] Date of Patent: Jul. 20, 1993

[54] CHILDPROOF LIGHTER

[75] Inventor: Rene Frigiere, Charbonnieres Les Bains, France

[73] Assignee: Cricket, Rillieux la Pape, France

[21] Appl. No.: 861,517

[22] Filed: Apr. 1, 1992

[30] Foreign Application Priority Data

Apr. 24, 1991 [FR] France ..... 91 05361

[51] Int. Cl.[5] ..... F23D 11/36

[52] U.S. Cl. ..... 431/255; 431/153; 222/153; 222/402.11

[58] Field of Search ..... 431/153, 277, 255; 222/153, 402.11

[56] References Cited

U.S. PATENT DOCUMENTS

| | | | |
|---|---|---|---|
| 3,169,672 | 2/1965 | Soffer et al. | 222/153 |
| 3,738,537 | 6/1973 | Gach | 222/153 |
| 4,752,020 | 6/1988 | Grueter et al. | 222/153 X |
| 4,784,602 | 11/1988 | Nitta | 431/153 |
| 4,786,248 | 11/1988 | Nitta . | |
| 4,799,877 | 1/1989 | Bisbee . | |
| 4,904,180 | 2/1990 | Nitta | 431/153 |
| 4,962,869 | 10/1990 | Gross et al. | 222/153 |
| 5,035,608 | 7/1991 | Parren | 431/153 |

FOREIGN PATENT DOCUMENTS

| | | |
|---|---|---|
| 8802582 | 2/1988 | Fed. Rep. of Germany . |
| 2295359 | 7/1976 | France . |

*Primary Examiner*—Carl D. Price

*Attorney, Agent, or Firm*—Herbert Dubno; Andrew Wilford

[57] ABSTRACT

A childproof lighter has a housing adapted to hold a supply of combustible fuel, a valve in the housing between the nozzle and the supply and actuatable to emit the fuel, and an igniter on the housing adjacent the valve. An actuating element is depressible longitudinally downward between an upper position and a lower position and is coupled to the valve and igniter for actuating same when depressed into the lower position. This actuating element is formed with a longitudinally downwardly projecting skirt itself formed with a longitudinally projecting and laterally elastically deflectable tongue in turn formed with a laterally projecting catch formation forming a longitudinally downwardly directed stop surface displaceable on elastic deformation of the tongue between an outer position and an inner position. The housing is formed with a longitudinally upwardly directed stop surface longitudinally aligned with the finger stop surface in the outer position of the finger and upper position of the element and out of longitudinal alignment with the finger stop surface in the inner position of the finger. Interengaging holding formations on the tongue and on the housing releasably retain the tongue in the inner position when the tongue is moved downward out of the upper position and the tongue is sufficiently elastic to resume its outer position when moved from the lower position into the upper position and when the holding formations are out of engagement with each other.

9 Claims, 3 Drawing Sheets

CHILDPROOF LIGHTER

FIELD OF THE INVENTION

The present invention relates to a lighter. More particularly this invention concerns a childproof lighter of the type used to ignite a cigarette, cigar, or the like.

BACKGROUND OF THE INVENTION

In order to prevent a child from having an accident with a cigarette lighter (which term is intended to cover such a device which can be used to light anything) it is standard to provide a latch arrangement that makes it difficult for anyone who does not know not to use the lighter to get a flame out of it. Typically a neutralizing mechanism is employed which must be moved from a blocking to a freeing position in order to be able to operate the standard operating lever or element.

This type of lighter is known in particular from German utility model 8,802,582.9 and from U.S. Pat. Nos. 4,786,248 and 4,799,877. In all these lighters a neutralizing means is not set up so as to be automatically returned to the actuatable neutralizing position after actuation of the igniting mechanism.

In commonly owned patent application Ser. No. 07/651,332 filed Feb. 7, 1991 (now U.S. Pat. No. 5,090,895) by Marcel Floriot a lighter is described having on its housing, in which is provided a reservoir containing the gas in liquid form, a head comprising, in addition to the burner valve connected with the reservoir via a pressure reducer, an igniting mechanism comprising control means for opening the burner valve and means for making sparks. Associated with the igniting mechanism is means for neutralizing this mechanism displaceable between an active neutralizing position for the igniting mechanism and a retracted position, these neutralizing means being displaceable manually by the user from their active position to the retracted position. The neutralizing means of the igniting mechanism is normally maintained in the neutralizing position and is in addition set up so as to be automatically returned to the neutralizing position after actuation of the igniting mechanism. Other such lighters are described in WO-A-90/12,254 and U.S. patent application Ser. No. 813,357 filed Dec. 24, 1991 (now U.S. Pat. No. 5,165,886) and French patent application 2,295,359 filed Dec. 15, 1975.

The main disadvantage of these system is that they all add perceptibly to the manufacturing cost of the lighter. At least one additional element must be added to the lighter and frequently the overall construction must be made considerably more complex. The result is obviously an increase in manufacturing costs that cannot be borne readily in a mass-production throwaway item.

OBJECTS OF THE INVENTION

It is therefore an object of the present invention to provide an improved childproof lighter.

Another object is the provision of such an improved childproof lighter which overcomes the above-given disadvantages, that is which is of no more complex construction than a standard lighter and which is no more expensive to manufacture.

SUMMARY OF THE INVENTION

The lighter according to the invention has a housing adapted to hold a supply of combustible fuel, a valve in the housing between the nozzle and the supply and actuatable to emit the fuel, and an igniter on the housing adjacent the valve actuatable for igniting the fuel. An actuating element is depressible downward at least generally along a longitudinal axis between an upper position and a lower position and is coupled to the valve and igniter for actuating same when depressed into the lower position. This actuating element is formed with a longitudinally downwardly projecting skirt itself formed with a longitudinally projecting and laterally elastically deflectable tongue in turn formed with a laterally projecting catch formation forming a longitudinally downwardly directed stop surface displaceable on elastic deformation of the tongue from an outer position into an inner position. The housing is formed with a longitudinally upwardly directed stop surface longitudinally aligned with the finger stop surface in the outer position of the finger and upper position of the element and out of longitudinal alignment with the finger stop surface in the inner position of the finger. Interengaging holding formations on the tongue and on the housing releasably retain the tongue in the inner position when the tongue is moved downward out of the upper position and the tongue is sufficiently elastic to resume its outer position when moved from the lower position into the upper position and when the holding formations are out of engagement with each other.

The childproof features of the lighter according to this invention add no significant cost to the manufacture of the lighter. No extra parts are required, merely a reshaping of the normally molded actuating button and housing. In fact the childproof lighter according to the instant invention can be made at the same cost as a similar lighter with no childproof features.

According to this invention the housing has an inner face forming one of the holding formations and inwardly engaging the tongue when sam is moved longitudinally down out of its upper position. Thus once the element starts to move down (it being noted that the reference to the vertical is purely for convenience and the lighter would work perfectly as well upside-down) the tongue is held in the inner position by engagement with the lighter housing, eliminating the need to hold it in from this point on.

The lighter according to the invention has interengaging holding formations o the tongue and on the housing for releasably retaining the tongue in its inner position and interengaging release formations on the tongue and on the housing for freeing the holding formations from each other when the tongue reaches its lower position. This eliminates the need to hold in the tongue while depressing the actuating button; instead the tongue is clicked in and then the button is pushed down. The interengaging release formations include a inclined end surface on the tongue. The igniter includes a piezoelectric igniter having an edge forming another of the interengaging release formations and engageable with the inclined end surface of the tongue. In addition the interengaging holding formations include a pair of bumps formed on the skirt and flanking the tongue and edge ridges formed on the tongue and engageable with the respective bumps. Once again, this structure is simply integrally molded into the housing and button and adds nothing to manufacture costs for the lighter.

The housing itself is formed with an upwardly open notch having a base surface constituting the stop surface of the housing. The catch formation engages outward into the notch in the upper position of the element. The tongue has a lower edge forming the tongue stop surface and it has an outwardly directed bump having a lower edge forming the tongue stop surface.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
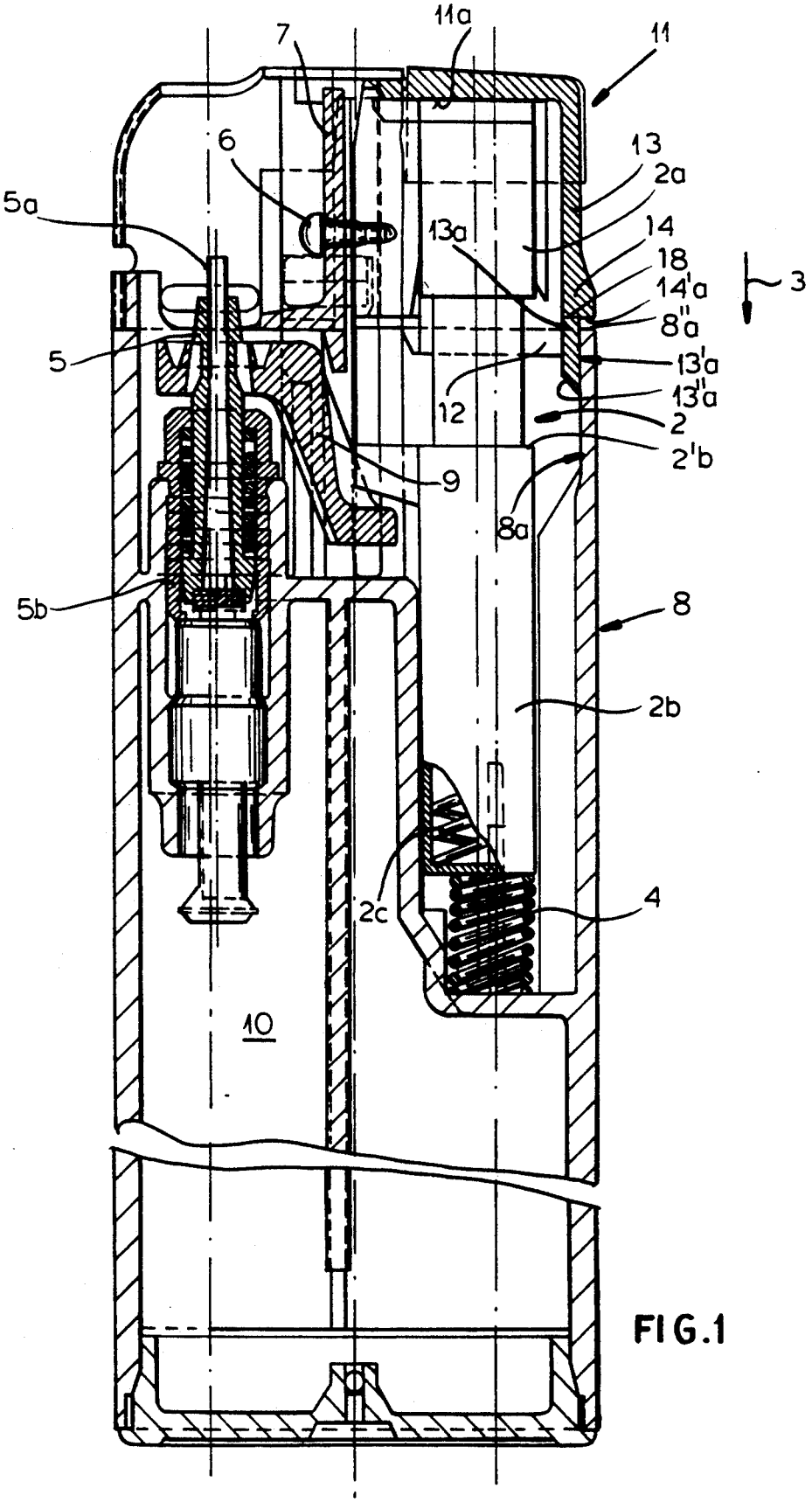
FIG. 1 is a vertical longitudinal section through the lighter according to the invention in the unactuated position.
Figure 2:
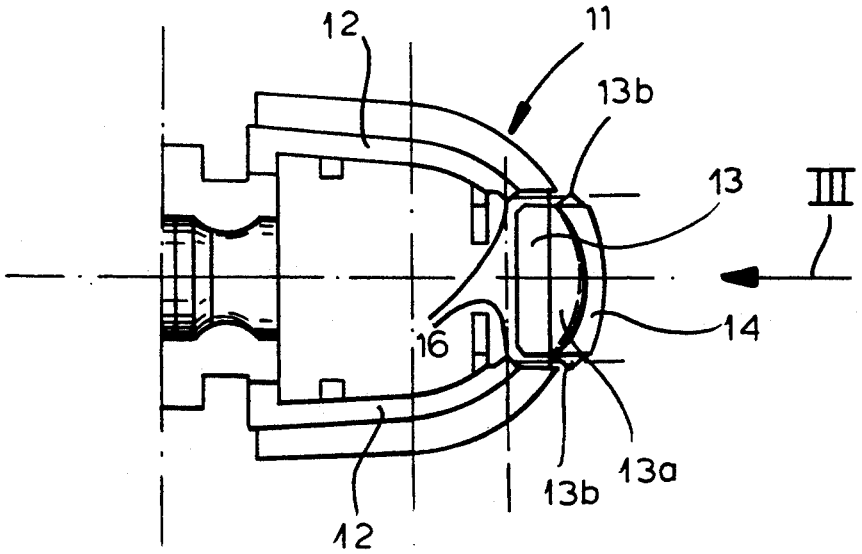
FIG. 2 is a bottom view of the actuating element of the lighter.
Figure 3:
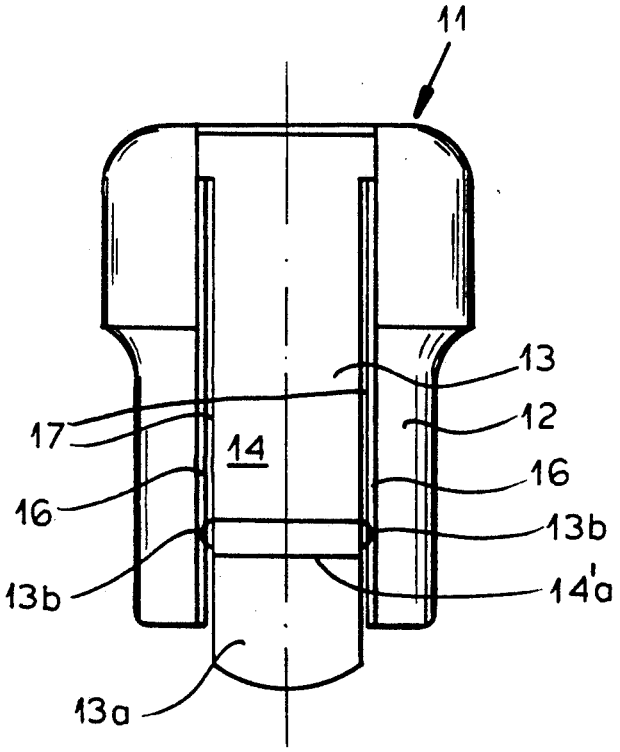
FIG. 3 is a side view of the actuating element taken in the direction of arrow III of FIG. 2.
Figure 5:
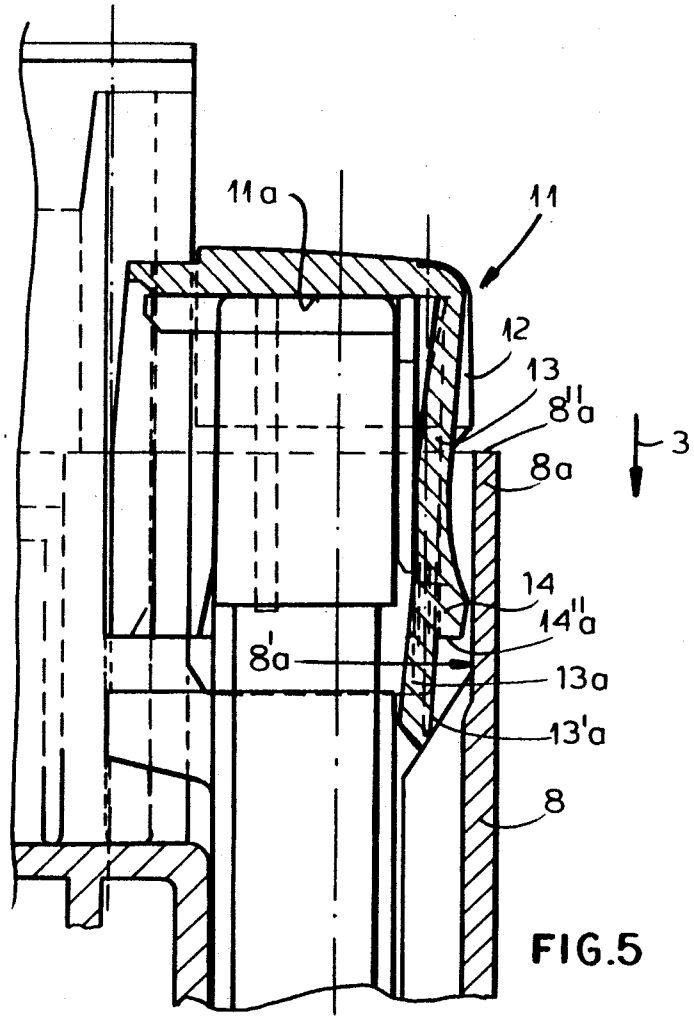
FIG. 5 is a view like FIG. 4 but showing the blocking element pushed in and the actuating element depressed.

As seen in FIG. 1 a lighter according to this invention has a piezoelectric igniter 2 sitting in a body or housing 8 of the lighter and having an upper part 2*a*, a lower part 2*b*, and an internal spring 2*c* pressing the two parts 2*a* and 2*b* apart. A spring 4 braced between the bottom part 2*b* and the housing 8 is somewhat softer than the spring 2*c*.

The housing 8 forms a reservoir 10 filled with liquefied butane and is provided with a burner 5 having a valve 5*b* and a nozzle 5*a* forming with an electrode 6 mounted on an adjacent housing partition 7 the two electrodes between which a spark is drawn when the igniter parts 2*a* and 2*b* are pressed together as is well known per se. An actuating element or button 11 has a lower surface 11*a* sitting atop the upper igniter part 2*a* and can be pressed longitudinally downward in the direction of arrow 3 so as first to push down a lever 9 that opens the valve 5*b* and causes the nozzle 5*a* to emit a jet of gasified butane, and then to strike a spark between the electrode 6 and the nozzle 5*a* to ignite this gas jet.

According to the invention the actuating button 11 is formed with a downwardly projecting skirt 12 that normally fits just within the complementary inner surface of the lighter body 8. A portion of this skirt is formed as a longitudinally downwardly projecting tongue 13 formed with a laterally outwardly projecting bump or catch formation 14 having an outwardly directed outer surface 14*a* and a downwardly directed stop surface 14'*a*. Similarly the tongue 13 has a lower end portion 13*a* formed with an outwardly directed outer surface 13'*a* that normally bears elastically outwardly against an inner surface 8'*a* of the housing 8 and an inclined end surface 13''*a*. The side wall of the housing 8 has an upwardly directed stop surface 8''*a* that is directly longitudinally aligned with the stop surface 14'*a* in the FIG. 1 position.

When not in use the elements of the lighter are in the position of FIG. 1 with the button 11 pushed all the way up by the combined action of the springs 2*c* and 4 and the tongue 12 pressing elastically outward with its outer surface 13'*a* against the inner surface 8'*a* of the housing 8. The stop surface 14'*a* of the catch formation 14 is spaced longitudinally slightly above the stop surface 8''*a* of the housing 8. When in this position a simple downward depression of the button 11 will have no effect as the two surfaces 14'*a* and 8''*a* will engage each other and prevent further downward depression of the button 11 before the valve 5*b* is opened.

Figure 4:
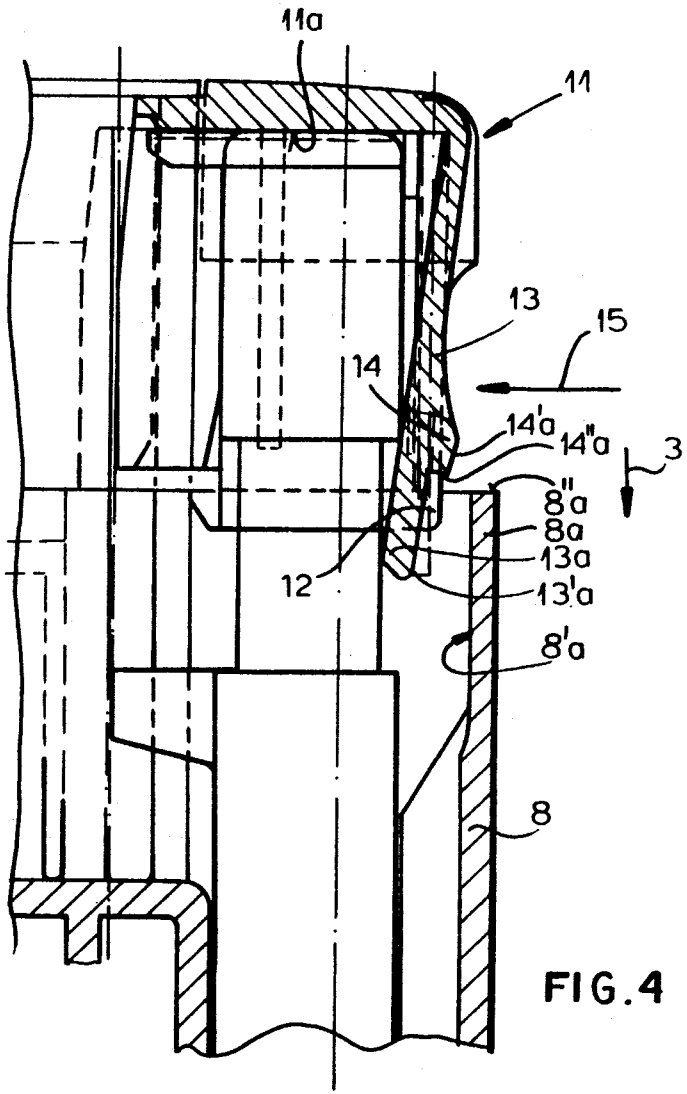
FIG. 4 is a large-scale vertical section through a detail of the lighter with the blocking element pushed in but the actuating element not depressed.

To operate the lighter the tongue 13 must be pressed transversely inward in the direction of arrow 15 as shown in FIG. 4 to move the surface 14'*a* out of longitudinal alignment with the surface 8''*a*. Once in this position the button 11 can be pressed downward far enough to open the valve 5*b* and fire the igniter 2. Once the stop surface 14'*a* moves downward past the surface 8''*a*, the outer surface 14*a* of the bump 14 will ride on the inner surface 8'*a* of the housing 8.

When the button 11 is released to pop back up, the inherent elasticity of the tongue 13 will cause it to swing back out into the FIG. 1 position, automatically resetting the child-proof feature of the lighter.

In order having to hold in the tongue 13 as the button 11 is depressed, the tongue 13 has side edges formed with oppositely outwardly projecting bumps 13*b* that can be pushed, with some elastic deformation of the tongue 14 and/or of the skirt 12, past ridges 16 formed on the side surfaces of the notch 17 formed in the skirt 12 and accommodating the tongue 14. Thus once the tongue 13 is pressed inward it will latch in this inner position so the button 11 can be pressed downward.

The inclined lower edge 13''*a* of the tongue end 13*a* is engageable with an edge 2'*b* of the igniter lower part 2*b* when the button 11 is pressed all the way down again to press the tongue 14 far enough outward to push the holding bumps 13*b* outward past the holding ridges 16. Thus even though the tongue 13 is latched in its inner position, once the lighter is operated it pops back out to reset the childproof feature.

It is possible in a low-cost variation on the invention to dispense with the tongue end portion 13*a* altogether. Thus the tongue has a lower surface such as indicated by dot-dash line 18 in FIG. 1.

The instant invention is not limited to the exact structure described above, instead all reasonable variations are intended to lie within the scope of the claims. For instance a standard flint-type igniter could be used instead of the crystal one. Similarly the slidable button 11 could be actually an end of a rocking actuating lever, in which case its movement would be somewhat arcuate, not totally in a straight line.

I claim:

1. A childproof lighter comprising:

a housing adapted to hold a supply of combustible fuel;

valve means including a valve on the housing between the nozzle and the supply and actuatable to emit the fuel;

ignition means on the housing adjacent the valve actuatable for igniting the fuel;

an actuating element having a longitudinally upwardly directed actuation surface and slidably depressible longitudinally downward by longitudinal downward engagement of a digit on the actuation surface between an upper position and a lower position and coupled to the valve and ignition means for actuating same when depressed into the lower position, the actuating element being formed immediately adjacent the actuation surface with a longitudinally downwardly projecting skirt itself formed with a longitudinally projecting and laterally elastically deflectable tongue in turn formed with a laterally projecting catch formation forming a longitudinally downwardly directed stop surface displaceable on elastic deformation of the tongue between an outer position and in inner position, the housing being formed with a longitudinally upwardly directed stop surface longitudinally aligned with the finger stop surface in the outer position of the finger and upper position of the element and out of longitudinal alignment with the finger stop surface in the inner position of the finger; and interengaging holding formations on the tongue and on the housing for releasably retaining the tongue in the inner position when the tongue is moved downward out of the upper position, the tongue being sufficiently elastic to resume its outer position when moved from the lower position into the upper position and when the holding formations are out of engagement with each other.

2. The childproof lighter defined in claim 1 wherein the housing has an inner face forming one of the holding formations and inwardly engaging the tongue when same is moved longitudinally down out of its upper position.

3. The childproof lighter defined in claim 1 wherein the housing is formed with an upwardly open notch having a base surface constituting the stop surface of the housing, the catch formation engaging outward into the notch in the upper position of the element.

4. The childproof lighter defined in claim 1 wherein the tongue has a lower edge forming the tongue stop surface.

5. The childproof lighter defined in claim 1 wherein the tongue has an outwardly directed bump having a lower edge forming the tongue stop surface.

6. A childproof lighter comprising:

a housing adapted to hold a supply of combustible fuel;

valve means including a valve on the housing between the nozzle and the supply and actuatable to emit the fuel;

ignition means on the housing adjacent the valve actuatable for igniting the fuel;

an actuating element slidably depressible longitudinally downward between an upper position and a lower position and coupled to the valve and ignition means for actuating same when depressed into the lower position, the actuating element being formed with a longitudinally downwardly projecting skirt itself formed with a longitudinally projecting and laterally elastically deflectable tongue in turn formed with a laterally projecting catch formation forming a longitudinally downwardly directed stop surface displaceable on elastic deformation of the tongue between an outer position and in inner position, the housing being formed with a longitudinally upwardly directed stop surface longitudinally aligned with the finger stop surface in the outer position of the finger and upper position of the element and out of longitudinal alignment with the finger stop surface in the inner position of the finger;

interengaging holding formations on the tongue and on the housing for releasably retaining the tongue in the inner position when the tongue is moved downward out of the upper position, the tongue being sufficiently elastic to resume its outer position when moved from the lower position into the upper position and when the holding formations are out of engagement with each other; and interengaging release formations on the tongue and on the ignition means for freeing the retaining formations from each other when the tongue reaches its lower position.

7. The childproof lighter defined in claim 6 wherein the interengaging release formations include an inclined end surface on the tongue.

8. The childproof lighter defined in claim 7 wherein the ignition means includes a piezoelectric igniter having an edge forming another of the interengaging release formations and engageable with the inclined end surface of the tongue.

9. The childproof lighter defined in claim 7 wherein the interengaging retaining formations include a pair of bumps formed on the skirt and flanking the tongue and edge ridges formed on the tongue and engageable with the respective bumps.

* * * * *